US007995779B2

(12) United States Patent
Petersen

(10) Patent No.: US 7,995,779 B2
(45) Date of Patent: Aug. 9, 2011

(54) METHOD FOR PROCESSING THE SIGNALS FROM TWO OR MORE MICROPHONES IN A LISTENING DEVICE AND LISTENING DEVICE WITH PLURAL MICROPHONES

(75) Inventor: Kim S. Petersen, Smørum (DK)

(73) Assignee: Oticon A/S (DK)

( * ) Notice: Subject to any disclaimer, the term of this patent is extended or adjusted under 35 U.S.C. 154(b) by 0 days.

(21) Appl. No.: 10/574,926

(22) PCT Filed: Sep. 16, 2004

(86) PCT No.: PCT/DK2004/000614

§ 371 (c)(1),
(2), (4) Date: Jun. 21, 2006

(87) PCT Pub. No.: WO2005/036924

PCT Pub. Date: Apr. 21, 2005

(65) Prior Publication Data

US 2007/0009121 A1 Jan. 11, 2007

(30) Foreign Application Priority Data

Oct. 10, 2003 (DK) ..... 2003 01502

(51) Int. Cl.
*H04R 25/00* (2006.01)
*G10K 11/16* (2006.01)

(52) U.S. Cl. ..... 381/317; 381/312; 381/322; 381/71.2

(58) Field of Classification Search ..... 381/312, 381/317, 92, 94.1, 313, 122, 71.2
See application file for complete search history.

(56) References Cited

U.S. PATENT DOCUMENTS

| | | | | |
|---|---|---|---|---|
| 5,276,739 | A | 1/1994 | Krokstad et al. | |
| 5,396,560 | A | 3/1995 | Arcos et al. | |
| 6,307,482 | B1 * | 10/2001 | Le Bel | 340/691.8 |
| 6,639,986 | B2 * | 10/2003 | Kanamori et al. | 381/71.1 |
| 7,606,376 | B2 * | 10/2009 | Eid et al. | 381/86 |
| 2001/0046304 | A1 * | 11/2001 | Rast | 381/74 |
| 2005/0063553 | A1 * | 3/2005 | Ozawa | 381/92 |

FOREIGN PATENT DOCUMENTS

DE 10145994 4/2003

OTHER PUBLICATIONS

Ken Hinckley et al, Sensing Techniques for Mobile Interaction, 2000, CHI Letters, vol. 2, 2.*
EPODOC Partial Translation of JP 2003143683A, dated May 16, 2003.
English translation of DE 10145994.

* cited by examiner

*Primary Examiner* — Devona E Faulk
*Assistant Examiner* — George Monikang
(74) *Attorney, Agent, or Firm* — Dykema Gossett PLLC

(57) ABSTRACT

A method for processing the signals from two or more microphones in a listening device, and a listening device for conducting the method which has a casing holding the microphones, a signal processing unit which provides an output signal corresponding to the microphone signals and suited to the user's hearing, and a receiver unit for delivering the output signal to the user whereby the signals from the microphones are analyzed in order to detect when the casing of the listening device is being touched, whereby further the signal processing of the signal processing unit changes whenever touching of the casing is detected.

7 Claims, 2 Drawing Sheets

METHOD FOR PROCESSING THE SIGNALS FROM TWO OR MORE MICROPHONES IN A LISTENING DEVICE AND LISTENING DEVICE WITH PLURAL MICROPHONES

AREA OF THE INVENTION

The invention relates to listening devices such as hearing aids, and in particular to listening devices having a casing and an array of microphones including two or more microphones, a signal processing device, and a receiver for delivering an output to the user of the listening device. Such devices encompass hearing aids and headsets and various other assistive listening devices.

BACKGROUND OF THE INVENTION

In listening devices of this kind it is a problem that the microphones need to be closely matched in order for a possible directional computational algorithms to function optimally. In order that the microphones stay matched over a long period, an automatic matching process is introduced. Here the signals from the microphones are continually analysed to ensure that over time there is no big difference in the output level from the microphones. In such listening devices it is also a problem that when the casing is accidentally touched or touched when applied to the ear, very loud sound output levels may be produced as the microphones are very sensitive to noise propagated through the material of the casing walls.

If substantial differences in the input to the microphones should occur, this might corrupt the outcome of the automatic matching process. Further, it has been discovered that such large differences are most likely to coincide with the occurrence of large and unpleasant noises which the user would prefer not to hear, like the noise which is produced when the casing is touched by the user. In hearing aids a large gain or amplification of the audio signal is introduced to compensate for the hearing loss of the user. This amplification amplifies all signals, wanted as well as non-wanted. The wanted signals usually originates some distance from the hearing aid and arrives travelling through the air. Noise from touching the hearing aid is very unpleasant since it results in a loud output signal from the hearing aid because of the frictional resistance, the banging from the acceleration of fingers, etc. The noise increases as the origin of the noise moves closer to one of the microphones in a multi-microphone hearing aid.

To overcome the above problem the invention provides a method for processing the signals from two or more microphones in a listening device whereby the signals from the microphones are analyzed in order to detect when the casing is touched, whereby changes in the signal processing are effected whenever touching of the casing is detected.

According to the invention, the time dependent differences in short term energy in the signals from the microphones is determined. This time related change may in itself provide information as to possible touching of the hearing aid casing, and also it may be further analysed to detect the occurrence of something or somebody touching the hearing aid casing with a higher degree of certainty.

Preferably the time related change in difference in the short term energy content in the microphone signals is used to determine the rate of change in difference between the short term energy of the microphone signals. Here touching noise will change the difference in measured energy between the two microphones very fast compared to other signals received by the microphones. Noise generated by wind will also change the input, but since it originates from turbulence, the mean energy level from the two microphones will not change fast because of the uncorrelated nature of the wind noise. Other ways of detecting touching noise are possible, but the short term energy differences are easily detected and it is easy to determine a reliable threshold where the signal processing should react to compensate for the loud noise. The threshold my comprise both a threshold for the absolute value of the difference in short term energy and a threshold for the rate of change of the difference in short term energy.

In an embodiment of the invention, the changes in the signal processing which are effected whenever touching of the casing is detected comprises short term muting or attenuation of the output signal in order to protect the user from the annoyance of the loud sounds caused by the touching of the casing.

In yet another embodiment of the invention the changes in the signal processing which are effected whenever touching of the casing is detected comprises a time limit shut down of an automatic microphone process. In this way it is ensured that the matching process is not disturbed by the large short term differences in the energy.

In a further embodiment of the invention the changes in the signal processing which are effected whenever touching of the casing is detected comprising lasting changes in the processing of the audio signal presented to the user of the listening device. Such changes could be program shifts, volume up or down or permanent muting of the listening device according to the wishes of user.

DESCRIPTION OF A PREFERRED EMBODIMENT

Figure 1:
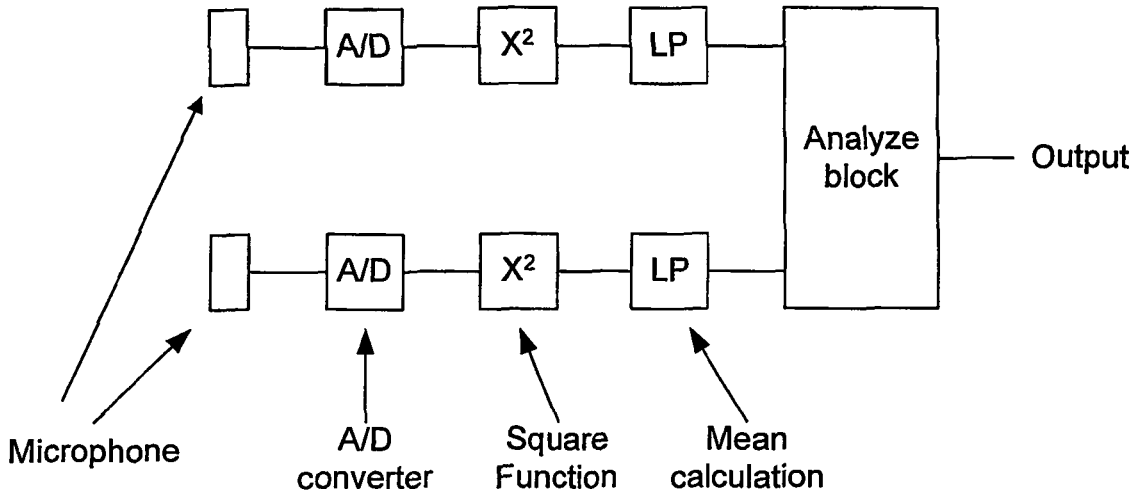
FIG. 1 shows the diagram of a detector to detect touch noise.

FIG. 1 shows one way to detect touching noise. Two microphones are provided which transform acoustical signals to analog electric signals. The analog signals are transformed into the digital domain in analog to digital converters. The signals are then transferred to a DSP unit or similar signal processing element. In the DSP unit the digital signal is treated in order to determine whether the signal from the microphones originates from the surroundings or is caused by something touching the shell of the hearing aid.

Initially a mean value of the energy in each of the two channels is calculated. One way to detect whether a signal originates from a touching noise is to analyse the difference or ratio between the energies in the two channels. If the ratio makes a fast shift, this is an indication that the signal originates from touching noise. When the presence of such a signal is determined, a value within the DSP is shifted, and other parts of the DSP unit may react to the shift of this value. One reaction could be to stop the automatic procedure for amplitude and/or phase matching of the two microphones. In this way it is assured that the microphone matching procedure is not influenced by the large differences in amplitude and/or phase which will occur when the hearing aid shell is touched. This may be extended such that the time pattern of the ratio between the two signals is determined for a given length of time. By doing this it becomes possible to determine the occurrence of repeated touching of the hearing aid. This could be used for communication of user input to the hearing aid. An example of user input could be program shifts or control of the volume.

In a further embodiment of the invention the sign of the difference between the energies or the size of the ratio is calculated, whereby it is possible to determine whether the hearing aid casing is touched near the one or near the other microphone opening. This can be used to distinguish between at least two different user inputs to the hearing aid.

As seen in FIG. 1, a measure for the energy content of the signal in the two microphone channels is obtained by calculating the square of the signal value. Hereafter a mean value calculator is provided which will smooth the signal and dispense with very short term changes and further a down sampling of the microphone signals can be achieved, such that the power for the calculations is diminished. In the signal analyse block the difference or ratio between the energy of the microphone signals is determined, and the temporal changes in this value is analysed.

At the casing a sound generating element can be arranged, which when touched provides a well defined sound impulse to the casing. This sound impulse may be detected through the analysis of the signal from the microphones. In this way the user can interact with the listening device through the microphones of the device in a secure manner. The advantage here is that the listening device can be made without an electromechanical button which is otherwise usual. The absence of the electro mechanical button is advantageous as the electrical connection thereof to the signal processing device then becomes superfluous.

Figure 2:
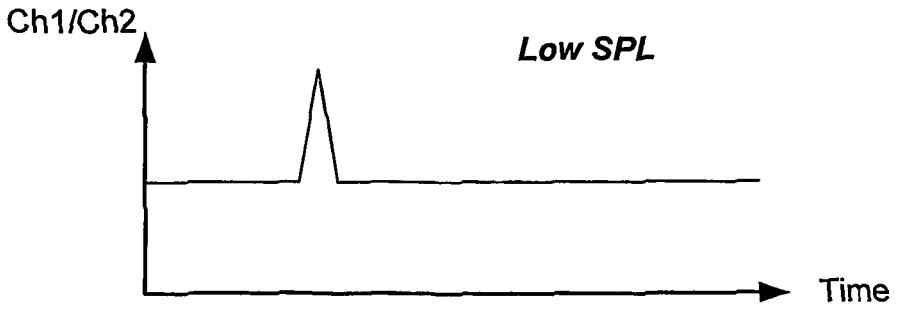
FIG. 2 shows the time related difference in short term energy content in two microphone channels where the sound level in the environment is low.

The analyse block determines whether the signal from the microphone originates from touching the casing or from a sound source in the environment. The input to the analyse block is an estimate of the power in each channel. On FIG. 2 the time related ratio between the two microphone channels is shown, whereby the vertical axis is the ratio: Ch1/Ch2 and the horizontal axis is time. If the signal is a normal acoustic signal, then the ratio is constant over a short-term period, and this is shown as the horizontal line in the graph. If the environment is relatively quiet, the noise from touching the microphone in channel I results in the ratio shown in FIG. 2. The peak in FIG. 2 originates from noise generated by touching of the casing material whereby a sudden change in the ratio between the energy contents in the two channels will occur which is registered by the analyse block. If the rate of change is above a given threshold, and at the same time the size of the value of Ch1/Ch2 is above a given threshold, it is determined that the hearing aid casing is touched.

Figure 3:
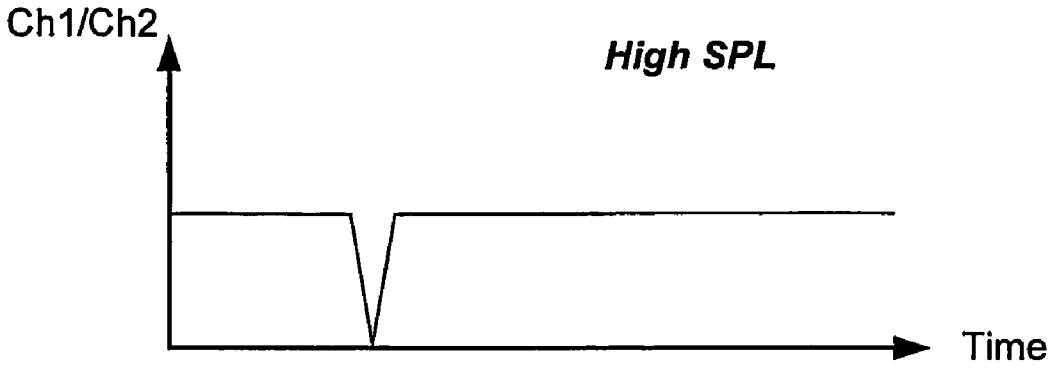
FIG. 3 shows the time related differences in short term energy content in two microphone channels where the sound level in the environment is high.

If the environment is not quiet, the touching and possible closing or covering of the microphone channel results in an attenuation of the incoming signal. The ratio between the two channels in this case is as shown in FIG. 3. This is useful in the event where the user is to communicate with the hearing aid in an environment with very loud sound pressure. Here the microphones may be saturated and any additional sound, such as might be generated by touching the shell cannot be detected whereas the sudden absence of sound in one channel is easily detected as a sudden change of the value Ch1/Ch2 and can be acted upon.

The analyse block can then extend this functionality to both microphones, so that the system reacts differently depending on which microphone the touching noise is centred.

Figure 4:
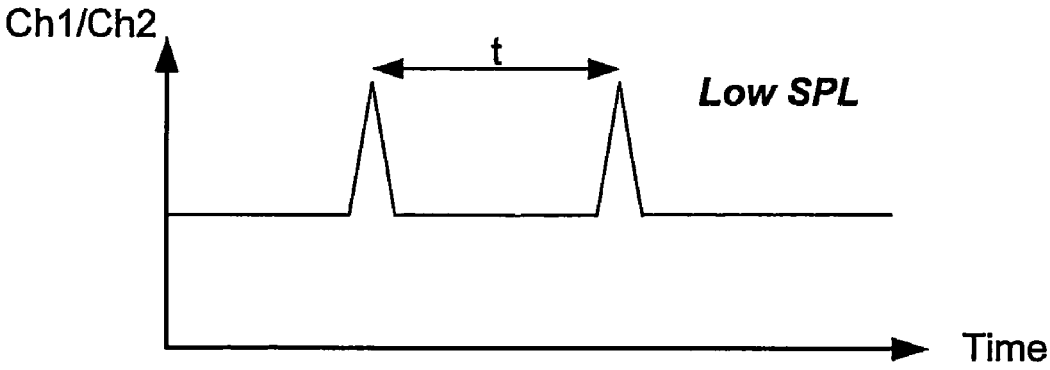
FIG. 4 shows the time related difference in short term energy content in two microphone channels whereby two distinct detections of touching events are made within a given time.

Another possibility is to measure the time between the touching of the inlets. The device could react differently if the inlets are touched more than ones in a specified time. This feature is showed in FIG. 4. By this possibility the user may be given the possibility to communicate with the hearing aid and have different actions like volume up, volume down or program changes effected.

The invention claimed is:

1. A method for processing signals from first and second microphones in a listening device which has a casing holding said first and second microphones, a signal processing unit which provides an output signal in correspondence with signals from said first and second microphones and suited to a user's hearing, and a receiver unit for delivering the output signal to the user, comprising the steps of (a) determining short term energy in the signals from each of the first and second microphones, and (b) changing the signal processing of the signal processing unit when a change in the difference over time in short term energy between the first and second microphone signals exceeds a threshold, wherein said threshold is selected so as to detect when said casing is being touched.

2. The method as claimed in claim 1, comprising using time related change in difference in the short term energy content in the microphone signals to determine the rate of change in difference between the short term energy of the microphone signals.

3. The method as claimed in claim 1, comprising changing a value in the signal processing unit whenever the rate of change in difference in the short term energy between the microphone signals reaches a pre-selected level in order to indicate that the casing is being touched.

4. The method as claimed in claim 2, comprising temporarily interrupting a microphone matching procedure whenever it is determined that the casing is being touched.

5. The method as claimed in claim 2, comprising temporarily attenuating the output signal to the user whenever it is determined that the casing is being touched.

6. The method as claimed in claim 2, accomplishing a lasting change in the signal processing whenever it is determined that a non-accidental touch of the casing has occurred.

7. The method of claim 1 further including the steps of:

calculating a respective square of the signal value for each of the signals from the first and second microphones;

determining a respective mean value for the calculated square values; and wherein the step of determining short term energy comprises determining a difference between the determined mean values associated with the first and second microphones.

* * * * *